US011565776B2

(12) United States Patent
McGuinness

(10) Patent No.: US 11,565,776 B2
(45) Date of Patent: Jan. 31, 2023

(54) HINGE SYSTEM AND A PORTABLE GANGWAY USING THE HINGE SYSTEM

(71) Applicant: MMG Welding Ltd., Killybegs (IE)

(72) Inventor: Martin McGuinness, Killybegs (IE)

(73) Assignee: MMG Welding Ltd., Killybegs (IE)

( * ) Notice: Subject to any disclaimer, the term of this patent is extended or adjusted under 35 U.S.C. 154(b) by 131 days.

(21) Appl. No.: 16/971,662

(22) PCT Filed: Feb. 22, 2019

(86) PCT No.: PCT/EP2019/054481

§ 371 (c)(1),
(2) Date: Aug. 20, 2020

(87) PCT Pub. No.: WO2019/162462

PCT Pub. Date: Aug. 29, 2019

(65) Prior Publication Data

US 2020/0391828 A1 Dec. 17, 2020

(30) Foreign Application Priority Data

Feb. 23, 2018 (GB) ..... 1802955

(51) Int. Cl.
*B63B 27/14* (2006.01)
*E04F 11/00* (2006.01)

(52) U.S. Cl.
CPC ..... *B63B 27/143* (2013.01); *E04F 11/002* (2013.01); *E04F 2011/005* (2013.01)

(58) Field of Classification Search
CPC ... B63B 27/14; B63B 27/143; E04F 2011/005
See application file for complete search history.

(56) References Cited

U.S. PATENT DOCUMENTS 6,119,634 A * 9/2000 Myrick ..... A01K 13/00 119/847
8,074,314 B2 12/2011 Lucht
8,292,565 B1 * 10/2012 Ruff ..... B60P 1/43 414/812

(Continued)

FOREIGN PATENT DOCUMENTS

DE 29623810 2/2000
DE 10348047 5/2005

(Continued)

OTHER PUBLICATIONS

International Search Report and Written Opinion issued in PCT/EP2019/054481, dated Jul. 8, 2019 (21 pages).

*Primary Examiner* — Andrew Polay
(74) *Attorney, Agent, or Firm* — ARC IP Law, PC; Joseph J. Mayo

(57) ABSTRACT

A hinge system (1, 1*a*) for use with a lightweight, portable gangway (100), the hinge system (1*a*) comprising at least three plates (2*a*,2*b*,2*c*), a bar (4) and a washer (6), wherein a first pair of the plates (2*a*,2*b*) are attached at either side of a lower surface (106) of a first section (102*a*) of the gangway (100) and the other plate (2*c*) is attached at approximately the centre of a second section (102*b*) of the gangway (100), so that when the sections (102*a*,102*b*) are brought towards each other, the first pair of the plates (2*a*,2*b*) are aligned with the other plate (2*c*).

19 Claims, 7 Drawing Sheets

(56) References Cited

U.S. PATENT DOCUMENTS

| | | | | |
|---|---|---|---|---|
| 2004/0098818 | A1* | 5/2004 | Kennedy | B63B 27/143<br>14/69.5 |
| 2009/0300859 | A1* | 12/2009 | Lucht | E04F 11/002<br>16/386 |
| 2020/0181964 | A1* | 6/2020 | Wu | E05F 1/1215 |

FOREIGN PATENT DOCUMENTS

| | | | | |
|---|---|---|---|---|
| DE | 10348047 | A1 * | 5/2005 | B63B 27/14 |
| WO | WO-9632317 | A1 * | 10/1996 | B63B 19/08 |

* cited by examiner

HINGE SYSTEM AND A PORTABLE GANGWAY USING THE HINGE SYSTEM

FIELD OF THE INVENTION

The invention relates to portable gangways and a hinge system for use with such gangways. Specifically, the invention relates to a hinge system for use with portable gangways and a portable gangway comprising the hinge.

BACKGROUND TO THE INVENTION

Generally, gangways used aboard ships, boats and pleasure craft come in varying guises and performance ability. For ships, the gangways tend to be heavy and require a crane, mechanical aid or another lifting machine to position the gangway in place. These gangways tend to be permanently fixed to the ship and are impossible to move without using the lifting machine. They are also capable of handling heavy loads. It would be impossible to use this type of gangway on a pleasure craft, fishing vessel or small boat due to space constraints and the weight of the gangways, at least.

Pleasure craft and small boats generally use portable, sometimes lightweight, but generally foldable gangways that can be either stored aboard the pleasure craft and boats or on dockside. They are also lightweight enough to be lifted and positioned by two or more people. The foldable gangways can either fold around a hinge or can be telescopic in nature. While these gangways are useful for getting on or off the boat, they are generally used on pleasure craft and would not be suitable for working boats such as fishing vessels, oil rig supply boats and the like, as the gangways would not be capable of bearing working loads on such vessels.

US Patent Application 31/34999 describes a lightweight, portable gangway suitable for use with and stored on a boat. The gangway is hinged in one position, bisecting the gangway in two. However, the gangway is constructed from plywood and a typical domestic door hinge, and is constructed for use on small boats. The gangway would not be capable of bearing much weight (no more than the weight of a couple of people at a time) and would not be suitable for use on offshore vessels such as fishing boats and supply boats.

French Patent Application No. 2869869 describes a gangway for a boat or the like that has two or three sections hinged together around an axis such that sections may fold on top of each other, wherein transverse slats act as steps and the gangway can be folded to a storage box or the like when in the folded position. Some of the sections of the gangway fold such that they fit into each other. The locking mechanism for each of the sections appears to be a nut and washer mechanism. However, the gangway uses a nut and bolt-type of hinge, and is generally used for pleasure craft, and would be not be capable of bearing much weight (no more than the weight of a couple of people at a time). The gangway would not be suitable for use on offshore vessels such as fishing boats and supply boats.

GB2355021 describes a walkway comprising a plurality of sections connected together by a pin and aperture hinging system and is generally used for lying over rough ground or for use in getting into restricted access sites, such as lofts, and would be not be capable of bearing much weight (no more than the weight of a couple of people at a time), nor being suitable for use on vessel.

None of the gangways mentioned above will pass the safe working load (SWL) tests required to meet the safety requirements for a load-bearing gangway for use in the industrial fishing or offshore vessel market. It is an object of the present invention to overcome at least one of the above-mentioned problems.

SUMMARY OF THE INVENTION

According to the invention, there is provided, as set out in the appended claims, a hinge system for use with a lightweight, portable gangway, the hinge system comprising at least three plates, a bar and a washer, wherein two plates are welded on either side of a lower surface of a section of the gangway and the other two plates are welded on either side of a second section of the gangway.

According to the invention, there is provided, as set out in the appended claims, a hinge system for use with a lightweight, portable gangway, the hinge system comprising at least three plates, each plate having a proximal end, a distal end and an edged surface; a bar and a washer, wherein a first pair of plates are attached at either side of a lower surface of a first section of the gangway and the other plate is attached at approximately the centre of a second section of the gangway, so that when the sections are brought towards each other, the proximal ends of the first pair of the plates are aligned with the proximal end of the other plate.

In one embodiment, the first pair of plates are welded on either side of a proximal end of either one of the sections and the other plate is welded to approximately the centre of the proximal end of either of the sections.

In one embodiment, the hinge system comprises at least four plates, wherein a first pair of the plates are attached at either side of a lower surface of a first section of the gangway and a second pair of the plates are attached at either side of a second section of the gangway, so that when the sections are brought towards each other, the proximal ends of the first pair of the plates are juxtaposed the proximal ends of the second pair of the plates, respectively. Preferably, the first and the second pairs of plates are welded on either side of a proximal end of the sections.

In one embodiment, when the plates are juxtaposed each other, the first pair of plates are external the second pair of plates.

In one embodiment, each plate further comprises a notch, and each plate tapers from the proximal end to the distal end.

In one embodiment, the proximal end has a surface area greater than that of the distal end and further comprises an aperture. In one embodiment, the aperture has a circumference that is larger than the circumference of the bar. The circumference should be large enough to provide resistance when the bar is being accommodated within the aperture of the plate, but not large enough so that the bar passes easily through the aperture.

Preferably, when the bar is threaded through the aperture of the first pair of the plates and the other plate or through the first and second pairs of the plates, the washer is welded to the plates and the bar, securing the bar in place. In one embodiment, when the bar is threaded through the aperture of the plates, the first pair of the plates and the second pair of the plates attached to the sections pivot around the bar.

In one embodiment, each plate is constructed from a lightweight material selected from aluminium, carbon steel, graphene, titanium, nylon, fibre glass, aluminium steel, carbon fibre and plastic. Preferably, the plastic is selected from carbon fibre, expanded polyvinyl chloride (PVC), high-density polyethylene, low-density polyethylene, polypropylene, polyamide-imide, fibreglass, epoxy, polyester resin, vinylester, or combinations thereof. Further examples include polyethylene 500 grade and Polyethylene PE 1000 grade.

In one embodiment, each plate is constructed from abrasion resistant steel or stainless steel.

In one embodiment, each plate is between about 100 mm to about 400 mm in length and about 50 mm to about 150 mm in height at the proximal end.

In one embodiment, the plate is between about 12 mm to 20 mm thick.

In one embodiment, the bar is constructed from stainless steel, abrasion resistant steel, carbon steel, nylon, graphene or titanium.

In one embodiment, there is provided a portable gangway for use with a ship or a boat, the gangway comprising at least two gangway sections and the hinge system described above, wherein each of the gangway sections comprise a body having an upper surface and a lower surface, a distal end and a proximal end, wherein the proximal end of each section is formed at an angle dimensioned to cooperate with the proximal end of another section to form a hinged section.

In one embodiment, the angle is an oblique angle of between 0.1 and 4.9° relative to the vertical axis, with the proviso that the combination of the angles at each proximal end of two gangway sections add up to 5°.

In one embodiment, the hinged section of the gangway is at a pitch of about 5° relative to the horizontal plane X.

In one embodiment, the upper surface further comprises a plurality of steps integrated into the body of the section. Preferably, the steps have integrated perforations suitable to allow liquid to drain therefrom.

In one embodiment, the upper surface further comprises a plurality of stanchions that are adapted to accommodate a handrail. Preferably, the stanchions are removable for ease of storage.

In one aspect, the handrail further comprises a bracket and bolt system, the system comprising a bracket having an aperture and a bolt, wherein the bracket is secured to the section and juxtaposed the stanchion where the stanchion also is secured to the section. Preferably, the bolt is threaded through the aperture in the bracket and through a further aperture in the stanchion to secure the stanchion in position.

In one aspect, the handrail further comprises a collapsible system, wherein the collapsible system comprises a hinge connecting an underside of the handrail with a proximal end of the stanchion.

In one aspect, the handrail further comprises a link bar linking two stanchions together. Preferably, the link bar is connected to two stanchions by the bracket and bolt system.

In one aspect, the bracket and bolt system further comprises a locking bolt adapted to secure the handrail and stanchions in position.

In one embodiment, the distal end further comprises a pair of wheels.

In one embodiment, the gangway can be folded compactly by pivoting one section around the hinge system so that it rests on the second section.

In one embodiment, the proximal end further comprises an aperture suitable to accommodate a locking means to secure the sections together when the gangway is in use.

In one aspect, the portable gangway further comprises a rail bracket, the rail bracket comprising a first pair of plates positioned apart and connected to a base, and a second pair of plates. Preferably, the base is perpendicular to the first pair of plates. Ideally, the first pair of plates and the base each comprise at least one aperture adapted for use in attaching the rail bracket to the gangway.

In one aspect, the second pair of plates are pivotally connected to the first pair of plates via a pivot pin that securely engages with the plates through an aperture in each.

In one aspect, the second pair of plates are typically bolted or secured to a vertical frame of a horizontal rail on the vessel or to a vertical frame on a pierhead or other structure to allow the gangway to be secured thereto.

In one aspect, the plates are locked together in a working or a folded position by engagement of a locking pin.

In one aspect, the arrangement of the plates and the base permits the rail bracket to hinge or swivel or pivot through 360 degrees.

In one embodiment, the plate is constructed from a lightweight material such as 15 mm aluminium (selected from grade 6063T6, 6082T6, 1050,5252 and 5083), carbon steel (selected from grade S235, S275, S355 and S460), stainless steel (selected from grades 316L and 304L), abrasion-resistant steel (such as WELDOX® or HARDOX®), graphene, or titanium.

In one embodiment, the plate is between about 100 mm to about 400 mm in length and about 50 mm to about 150 mm in height at the proximal end. Preferably, the plate is between about 150 mm to about 350 mm in length and about 75 mm to about 125 mm in height at the proximal end. More preferably, the plate is between about 200 mm to about 300 mm in length and about 90 mm to about 120 mm in height at the proximal end. Ideally, the plate is about 250 mm in length and about 100 mm in height at the proximal end. Preferably, the plate is between about 10 mm to 25 mm thick. More preferably, the plate is between about 12 mm to 20 mm thick. Ideally, the plate is about 15 mm thick. In one embodiment, the bar is constructed from 30 mm stainless steel (selected from grades 316L, 304L, 410L, 420, 430, 439, S30815, 314, 310S, 409, 430TI, 4589, 305, 301, 441, 321, 444, DX2101, DX2304, DX2205,), abrasion-resistant steel (such as WELDOX® or HARDOX®), carbon steel (selected from grade S235, S275, S355 and S460), graphene, titanium or nylon.

In one embodiment, the washer is made from stainless steel (selected from grades 316L and 304L), abrasion-resistant steel (such as WELDOX® or HARDOX®), carbon steel (selected from grade S235, S275, S355 and S460) and aluminium (selected from grades 6063T6, 6082T6, 1050, 5252 and 5083).

In one embodiment, the gangway is constructed from a lightweight material such as aluminium grade 2014-T6, aluminium grade 6082-T6, titanium, graphene, fibre glass, wood, or combinations thereof.

In one embodiment, the gangway is between about 4.8 meters and about 8.2 meters in length. Preferably, the gangway is between about 5.5 meters and about 7.5 meters in length. More preferably, the gangway is between about 6 meters and about 6.5 meters in length. Ideally, the gangway is about 6.2 meters in length. When in storage, the gangway is between about 2.4 meters and 4.1 meters in length. Preferably, the gangway is about 2.75 meters and about 3.75 meters in length when in storage. More preferably, the gangway is between about 3 meters and about 3.25 meters in length when in storage. Ideally, the gangway is about 3 meters in length when in storage. The width of the gangway sections is between about 300 m and about 800 mm; preferably between about 400 mm and about 700 mm; more preferably between about 450 mm and 600 mm; and ideally between about 480 mm and 550 mm. In one embodiment, the gangway section has a width of about 500 mm. The depth of the gangway sections is between about 150 mm and about 500 mm; preferably between about 200 mm and about 400 mm; more preferably between about 250 mm and 350 mm; and ideally between about 275 mm and 300 mm. In one embodiment, the gangway section has a depth of about 290 mm.

Definitions

In the specification, the term "ship" should be understood to mean a seagoing vessel that travels the world's oceans and other sufficiently deep waterways, can remain at sea for longer periods of time than boats, and carries passengers or goods. Ships are generally distinguished from boats, based on size (a common notion is that a ship can carry a boat, but not vice versa), shape, load capacity, and tradition.

In the specification, the term "boat" should be understood to mean a craft designed to float and travel on water, and work as an offshore vessel. A boat is a vessel small enough to be carried aboard another vessel (a ship) or a vessel that can be lifted out of the water. Ships are generally distinguished from boats based on their larger size, shape and cargo or passenger capacity. Examples of boats include fishing boats (trawlers and the like), offshore supply vessels, pleasure craft (ski boats, pontoon boats, house boats, sailboats, motorboats) and lifeboats.

In the specification, the term "gangway" or "walkway" should be understood to be distinctly different from a ramp in that they are designed to be used at between about 0 and 5% gradients and tend to be used as pedestrian walkways getting to and from a boat moored alongside. The terms can be used interchangeably.

In the specification, the term "formed at an angle", in relation to the hinged section of the gangway of the invention, should be understood to mean that the proximal end of the section is either cut or molded at an angle, typically an oblique angle, that produces a pitch of between about 2° and about 8°, preferably between about 3° and about 7, more preferably between about 4° and about 6°, and ideally about 5°, when the proximal ends of two sections cooperate with each other.

BRIEF DESCRIPTION OF THE DRAWINGS

The invention will be more clearly understood from the following description of an embodiment thereof, given by way of example only, with reference to the accompanying drawings, in which:—

DETAILED DESCRIPTION OF THE DRAWINGS

The present invention provides a hinge system for use with a lightweight, portable and foldable/collapsible gangway. The gangway can be secured in an area of a vessel, for example, alongside the boats rail, behind the wheelhouse, on top of the gantry or even on the wheelhouse roof. When the vessel lands at port, two crew members will be able to lift and position the gangway alongside the vessel's railings and open it out to its fully extended state.

Figure 1:
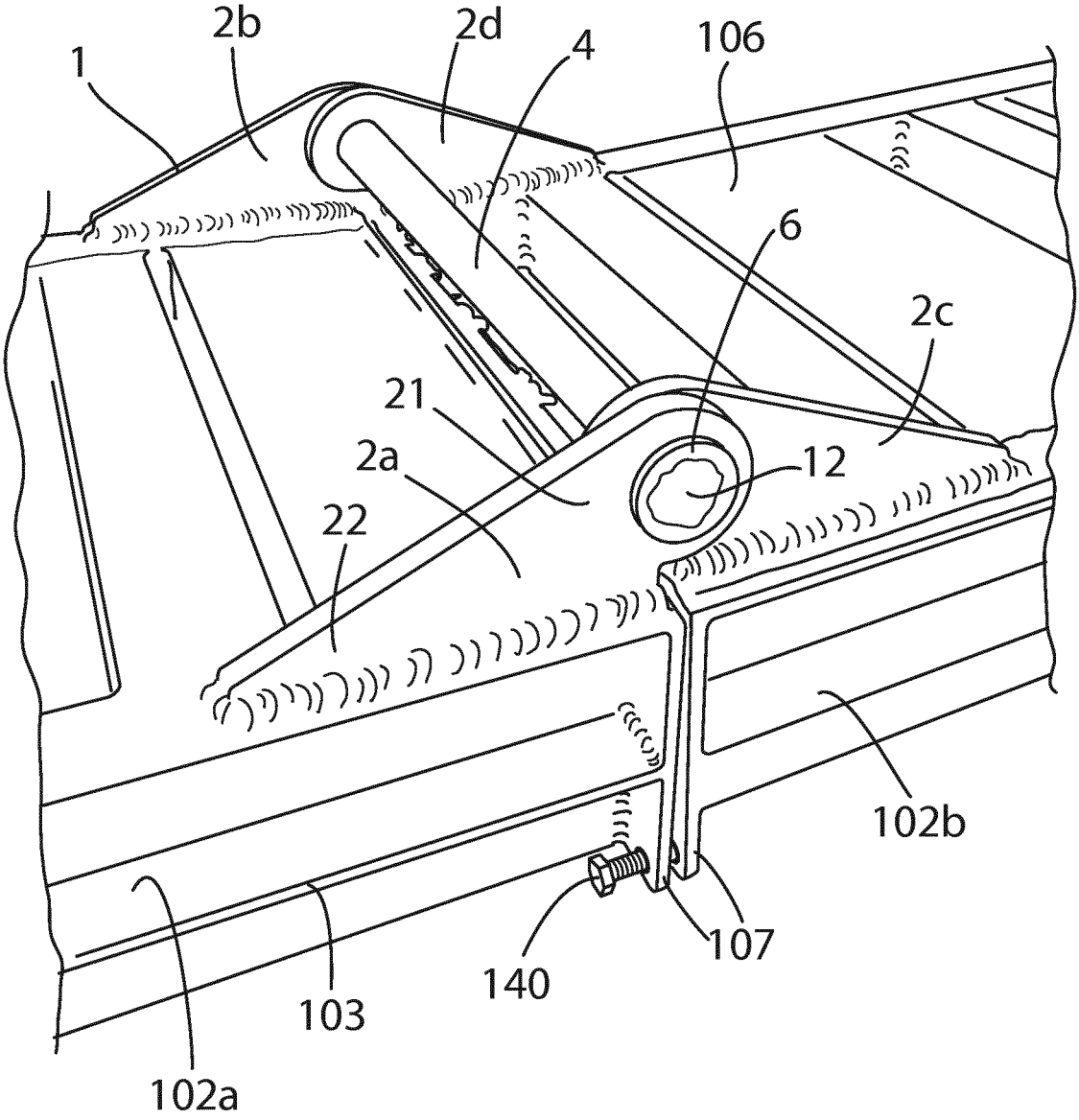
FIG. 1 illustrates an embodiment of the hinge system of the invention fitted to the underside of two sections of a gangway.
Figure 3:
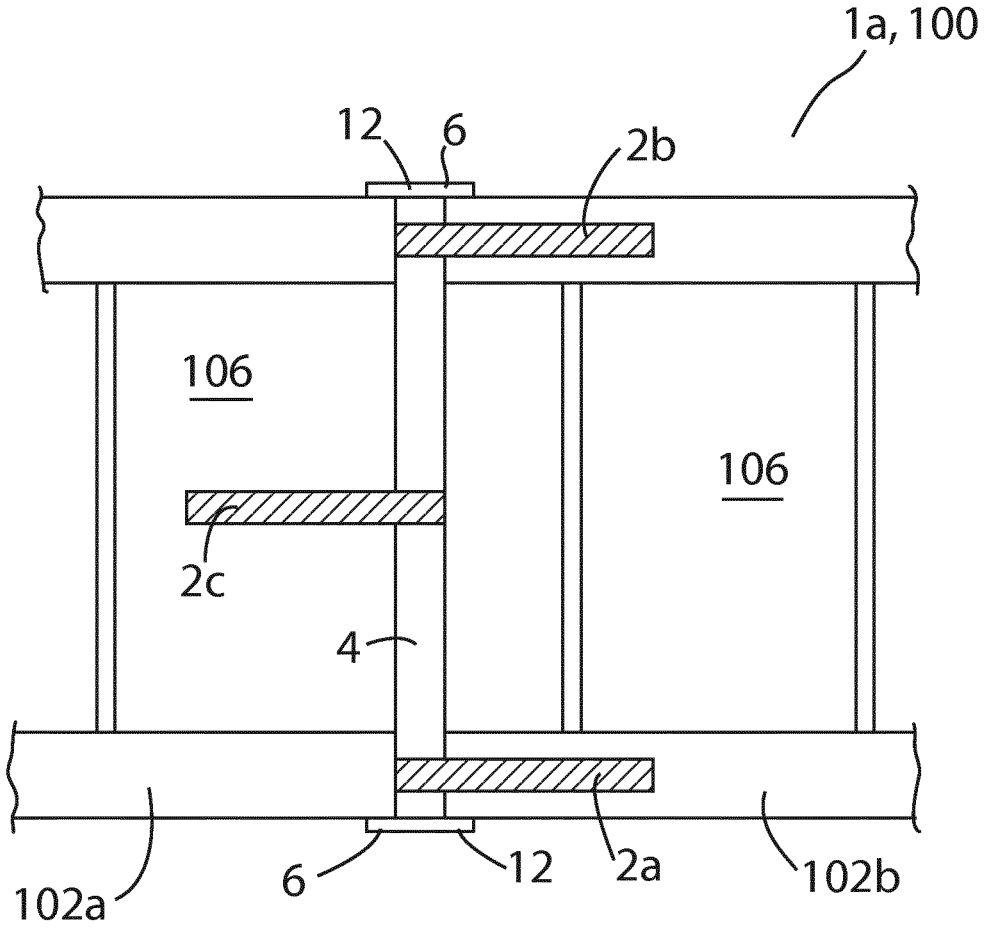
FIG. 3 illustrates an embodiment of the hinge system of the invention fitted to the underside of two sections of a gangway.

Referring now to the figures, where FIG. 1 illustrates a general embodiment of a hinge system of the present invention. Specifically, FIG. 1 illustrates a perspective view of a hinge system of the present invention attached to an example of a lightweight, portable gangway, and is generally referred to by reference numeral 1. FIG. 3 illustrates the components of the hinge system 1. The hinge system 1 comprises two pairs of plates 2*a*,2*b*,2*c*,2*d* at opposite sides of a gangway section 102*a*,102*b*, respectively. The plates 2*a*,2*b*,2*c*,2*d* are connected together by a bar 4 that traverses the distance across the width of the gangway section 102*a*,102*b*. The bar 4 is accommodated within an aperture 10 (see FIG. 3) in each of the plates 2*a*,2*b*,2*c*,2*d*. The bar 4 is secured in place by placing a washer 6 on each of an end 12 of the bar 4 (see FIG. 3 also). The washer 6 is welded to the plate 2*a*,2*b* and the ends 12 of the bar 4 to secure the bar 4 in place.

Figure 2:
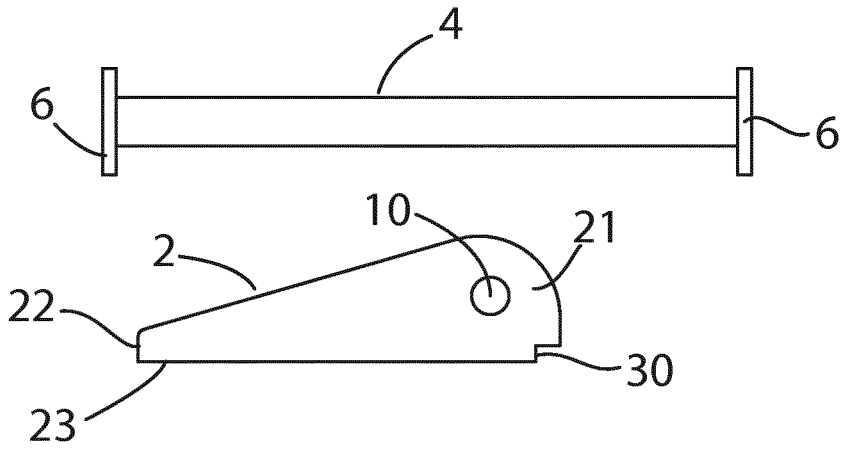
FIG. 2 illustrates components of the hinge system of the invention.

Referring now to FIG. 2, which illustrates a further embodiment of the hinge system 1 of the present invention and in which parts or steps described with reference to the previous embodiment are assigned the same numerals. Specifically, FIG. 2 illustrates that the hinge system 1*a* can comprise three plates, with two plates 2*a*,2*b* at opposite sides of the gangway section 102*a*, and one plate 2*c* located approximately in the centre of the gangway section 102*b*. The plates 2*a*,2*b*,2*c* are connected together by the bar 4 that traverses the distance across the width of the gangway section 102*a*,102*b*. The bar 4 is accommodated within the aperture 10 (see FIG. 3) in each of the plates 2*a*,2*b*,2*c*. The bar 4 is secured in place by placing the washer 6 on each of the ends 12 of the bar 4 (see FIG. 3 also). The washer 6 is welded to the plate 2*a*,2*b* and the ends 12 of the bar 4 to secure the bar 4 in place. It should be understood that the two plates 2*a*,2*b* can also be positioned at opposite sides of the gangway section 102*b*, and the one plate 2*c* located approximately in the centre of the gangway section 102*a*.

Each plate 2 is cut from a sheet of metal and comprises a proximal end 21 and a distal end 22. The proximal end 21 accommodates the aperture 10. In this embodiment, the plate 2 tapers from the proximal end 21 to the distal end 22. The plate 2 further comprises an edged surface 23. Where the proximal end 21 and the edged surface 23 meet, there is a notch 30 cut out of the plate 2. The notch 30 allows the plate 2 to be welded completely onto the section 102 of the gangway 100. The notch 30 allows for a fully penetrated fillet weld completely around the plate 2, thus providing a secure attachment to the gangway 100.

Figure 4:
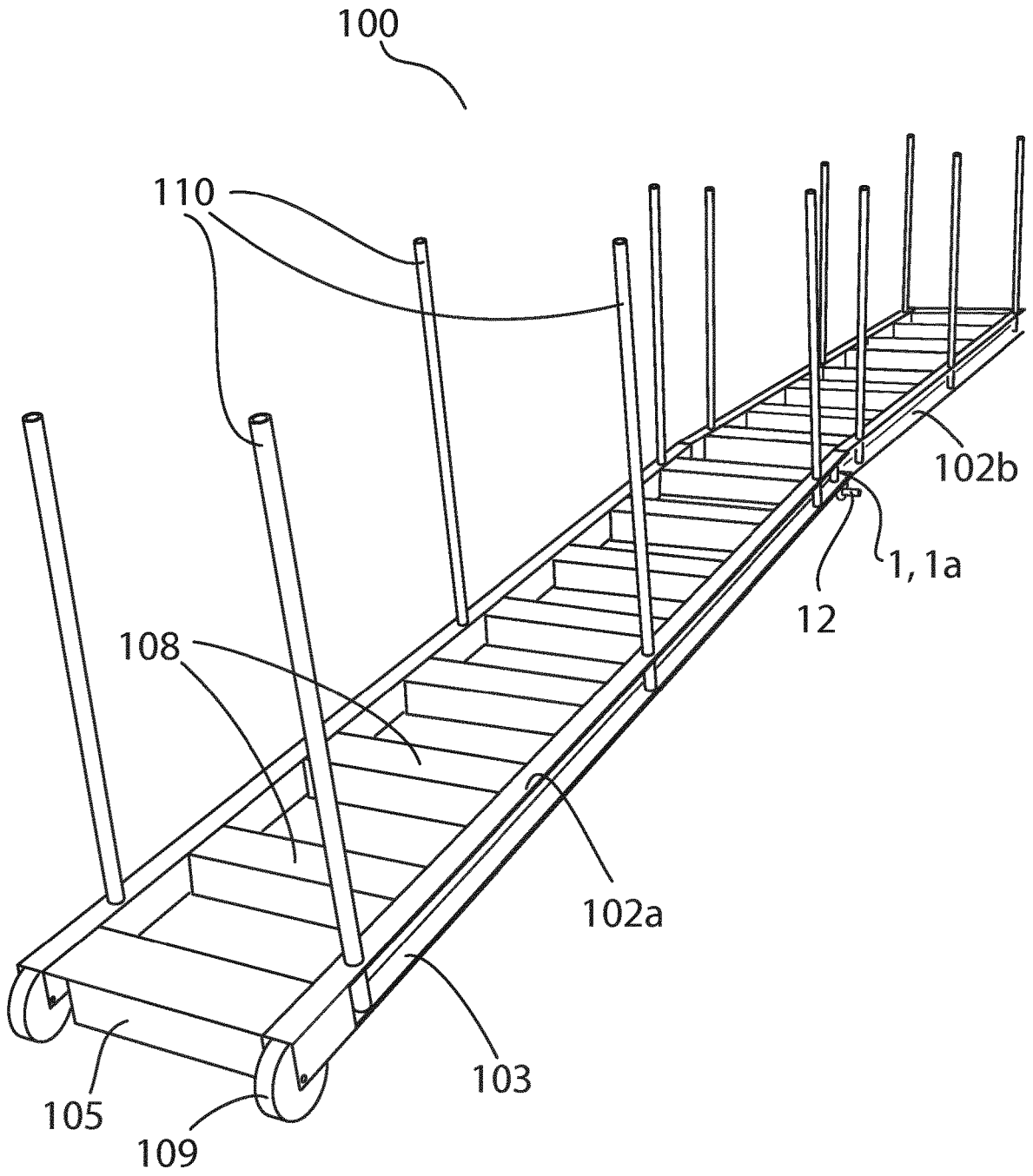
FIG. 4 illustrates a gangway incorporating the hinge system of FIG. 1, FIG. 2 and/or FIG. 3.

FIG. 4 shows an example of a lightweight and portable gangway 100 that incorporates the hinge system 1,1*a*. The gangway of the present invention is generally referred to by reference numeral 100. The gangway 100 comprises at least two gangway sections 102*a*,102*b* that are connected together by the hinge system 1,1*a*. Each gangway section 102*a*,102*b* comprises a body 103 having an upper surface 104 and a lower surface 106, a distal end 105 and a proximal end 107. The upper surface 104 further comprises a plurality of steps 108 integrated into the body 103 of the sections 102*a*,102*b* and a plurality of stanchions 110 that are adapted to accommodate a handrail 150 and are removable or foldable to permit folding and storage of the gangway 100. The distal end 105 further comprises a pair of wheels 109 adapted to permit the user to roll the gangway 100 along a surface. The proximal end 107 of each section 102*a*,102*b* are aligned with each other to accommodate the hinge system 1,1*a*.

Figure 8:
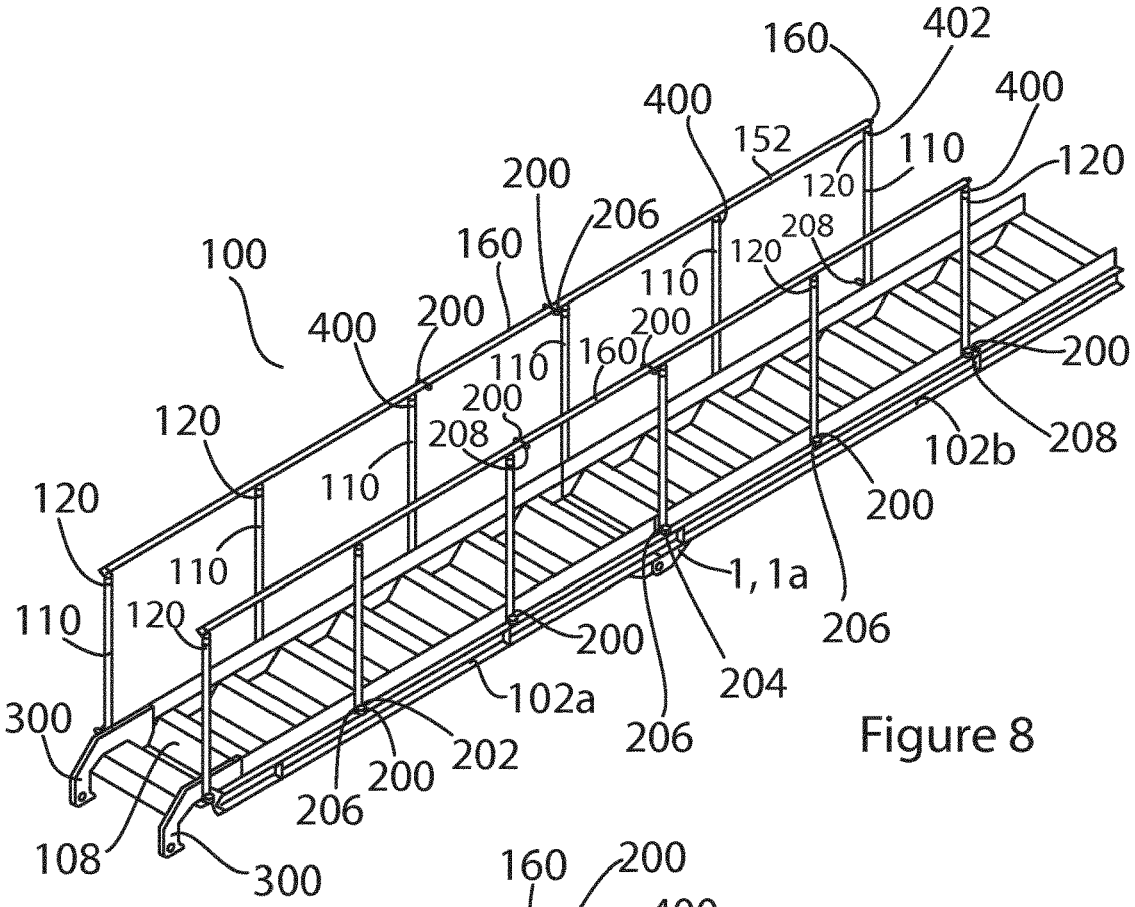
FIG. 8 illustrates a perspective view of the gangway of FIG. 4 with a handrail and the rail bracket of FIG. 6 and FIG. 7.
Figure 9:
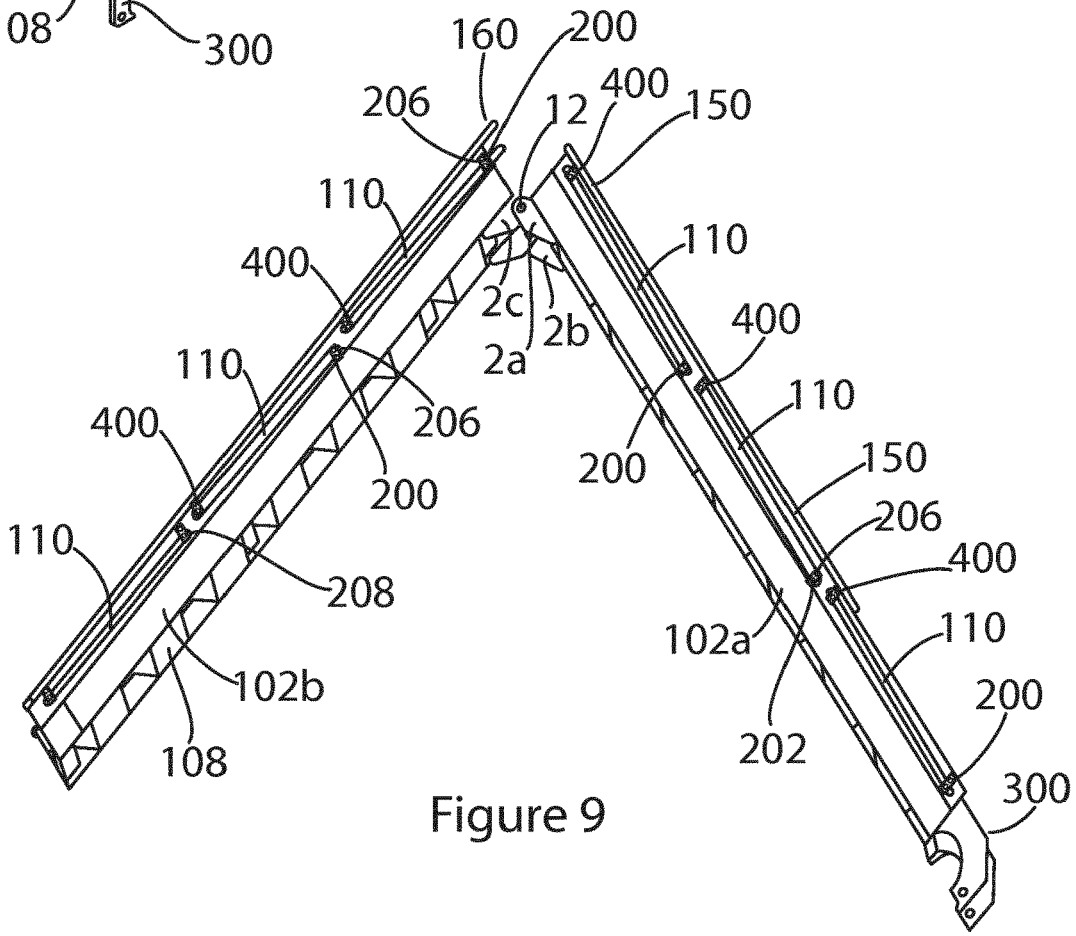
FIG. 9 illustrates a view of the gangway of FIG. 8 in a semi-folded position, wherein the handrail is collapsed and secured to the gangway sections.

In one aspect, the stanchions 110 are attached to the sections 102*a*,102*b* by means of a bracket and bolt system 200 (see FIG. 8 and FIG. 9). The bracket and bolt system 200 comprise a bracket 202 having an aperture 204, the bracket 202 secured to the section 102*a*,102*b* and juxtaposed the stanchion 110 where the stanchion 110 also is secured to the section 102*a*,102*b*. A bolt 206 is threaded through the aperture 204 in the bracket 202 and through a further aperture 205 in the stanchion 110. The base of each stanchion 110 of the handrail 150 is linked to the bracket and bolt system 200. A locking bolt 208 is used in place of the bolt 206 in the system 200 used to connect the stanchion 110 with the section 102*a*,102*b* at the end distal to where a rail bracket 300 is connected to the gangway 100. When the locking bolt 208 is removed from the system 200, the handrail 150 collapses down to a folded position. Once in the folded position, the locking bolt 208 is reinserted into the apertures 204,205 to lock the handrail 150 in the folded position with the gangway 100.

The stanchions 110 are also attached to the horizontal handrail 150 using a collapsible system 400. The collapsible system 400 comprises a hinge 402 connecting an underside 152 of the handrail 150 with a proximal end 120 of the stanchion 110. The handrail 150 further comprises a link bar 160 linking two stanchions 110 together. The link bar 160 is connected to the two stanchions 110 by the bracket and bolt system 200 with the locking bolt 208 used on one end, and the bolt 206 used on the other end, as described above.

To fold or collapse the handrail 150 down for storage, the bracket and bolt system 200 is dismantled by removing the locking bolt 208 connecting the link bar 160 to the stanchions 110 and connecting the stanchions 110 to the sections 102*a*,102*b*. Once dismantled, the link bar 160 is removed, and the handrail 150 collapses down through the hinging of the collapsible system 400. The handrail 150 and stanchions 110 store flat with the sections 102*a*,102*b* of the gangway 100 (see FIG. 9). As described above, the locking bolt 208 is reinserted into the apertures 204,205 of the bracket and bolt system 200 to lock the handrail 150 (and the link bar 160) in the folded position on the gangway 100. This procedure is done to both handrails 150 when two are present on the gangway 100.

In order to construct the hinge system 1, the edged surface 23 of the plate 2 is placed on the lower surface 106 at the proximal end 107 of the section 102*a*,102*b*. The proximal end 21 of the plate 2 extends outwards and away from the proximal end 107. The positioning of the proximal ends 21 extending outward and way from the proximal end 107 is to ensure that the bar 4, when engaged with the plates 2*a*,2*b*, 2*c*,2*d*, is centred over the meeting of the sections 102*a*,102*b*. The centring of the bar 4 allows the sections 102*a*,102*b* rotate or hinge in a 1800 range of motion. The plate 2 is welded in place on the lower surface 106 of the gangway section 102*a*,102*b*. One plate 2*a*,2*b* is placed on either side of the proximal end 107 of the section 102*a* (and likewise for plates 2*c*,2*d* on section 102*b*), forming a pair of plates 2*a*,2*b* and 2*c*,2*d* on each section 102*a*,102*b*, respectively. To create the gangway 100, the at least two sections 102*a*,102*b* are brought together at their proximal ends 107, and the proximal ends 21 of the plates 2*a*,2*b*,2*c*,2*d* are juxtaposed each other to allow the bar 4 to traverse the width of the sections 102*a*,102*b*. The bar 4 is accommodated within the apertures 10 of the plates 2*a*,2*b*,2*c*,2*d*, which are lined up to create a uniform aperture between the four plates 2*a*,2*b*,2*c*,2*d* on the lower surface 106 of the sections 102*a*,102*b*.

As shown in the embodiment of FIG. 1, when the plates 2*a*,2*b*,2*c*,2*d* are juxtaposed each other, the first pair of plates 2*a*,2*b* are positioned external the second pair of plates 2*c*,2*d*. It should be understood that the second pair of plates 2*c*,2*d* could also be positioned external the first pair of plates 2*a*,2*b*; or the plates 2*a*,2*b*,2*c*,2*d* could be positioned so that the plates 2 alternate, for example, 2*a* outside 2*c* and 2*d* outside 2*b* or 2*c* outside 2*a* and 2*b* outside 2*d*, and so on in an alternating fashion.

When referring to the construction of the hinge system 1*a*, the plates 2*a*,2*b* are welded in place on the lower surface 106 of the gangway section 102*a* (or 102*b*). One plate 2*a*,2*b* is placed on either side of the proximal end 107 of the section 102*a* (or of the section 102*b*), forming a pair of plates 2*a*,2*b* on section 102*a* (or 102*b*). The plate 2*c* is welded in place in approximately the centre of the lower surface 106 of the gangway section 102*b* (or 102*a*). To create the gangway 100, the at least two sections 102*a*,102*b* are brought together at their proximal ends 107, and the proximal ends 21 of the plates 2*a*,2*b*,2*c* are brought in line with each other to allow the bar 4 to traverse the width of the sections 102*a*,102*b*. The bar 4 is accommodated within the apertures 10 of the plates 2*a*,2*b*,2*c*, which are lined up to create a uniform aperture between the four plates 2*a*,2*b*,2*c* on the lower surface 106 of the sections 102*a*,102*b*.

Each of the plates 2 in the hinge system 1,*a* are further welded in place by providing multiple passes of, for example, ARC welding, metal inert gas (MIG) welding, Gas tungsten ARC welding (GTAW or tungsten inert gas (TIG) welding), flux-cored ARC welding (FCAW), Gas metal ARC welding (GMAW), Plasma ARC welding (PAW), Shielded metal ARC welding (SMAW) and Submerged ARC welding (SAW). The washer 6 is then welded in place on the bar 4. Once this is completed, the sections 102*a*,102*b* can fold over on themselves. It should be noted that 3, 4, 5, 6, 7 or any number of sections 102 can be put together to form the gangway 100.

When the gangway 100 is opened out and in use, a locking means 140 is engaged to secure the proximal ends 107 of the sections 102 together (see FIG. 1). The locking means 140 is typically found towards the upper surface 104 of the body 103. A typical locking mechanism that can be used with the invention is any suitable locking means known to the skilled person, such as a nut and bolt arrangement, a lock and key arrangement, a cam lock, a cabin hook (a hooked bar that engages into a staple), a toggle latch, a padlock and the like. A nut and bolt locking means is illustrated in FIG. 1.

Figure 5:
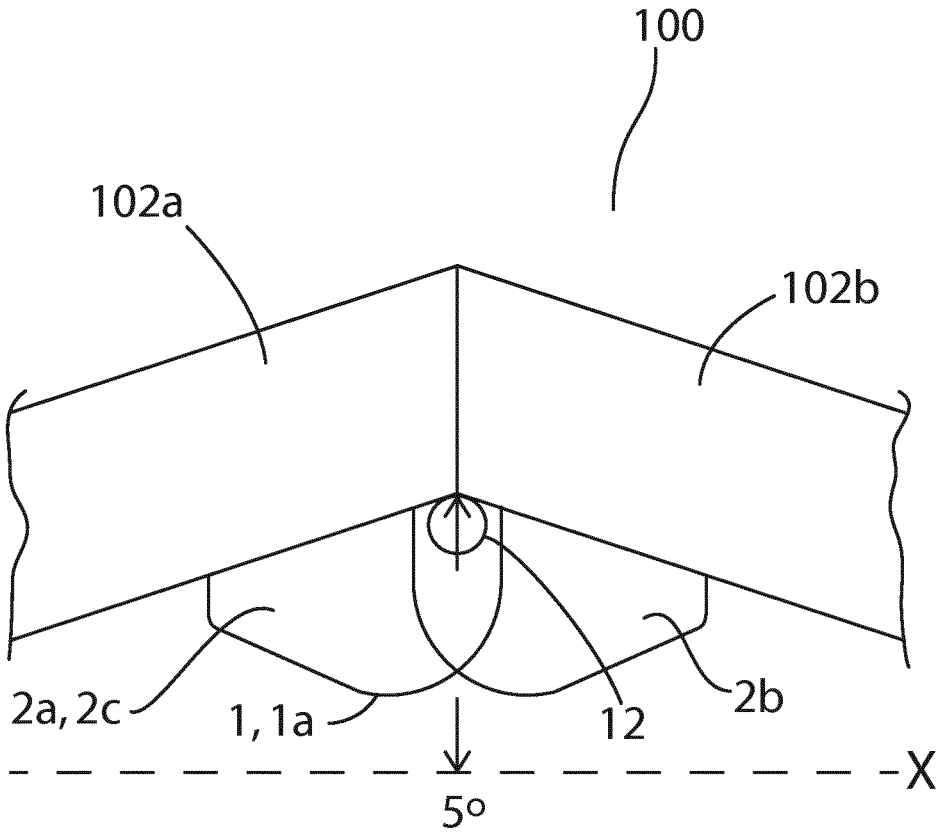
FIG. 5 illustrates a side view of the hinged section of the gangway of FIG. 4 using the hinge system of FIGS. 1 and 3, where the hinged section is at a 5° pitch, relative to the horizontal plane X.

The proximal ends 107 of each section 102 are cut or molded at an oblique angle (relative to the vertical axis) dimensioned to cooperate with a similarly dimensioned proximal end 107 of other sections 102 to form a hinged section. When in cooperation with each other, the hinged section that is formed has a pitch of about 5° relative to the horizontal plane X. FIG. 5 illustrates a side view of the hinge system 1,1*a* on the gangway 100 of FIG. 4 and the hinged system that is formed. When the sections 102*a*,102*b* are folded out and locked in position using the locking means 140, the oblique angle of the proximal ends 107 of the sections 102*a*,102*b* prevents the sections 102 of the gangway 100 from reaching a fully horizontal position, and the hinged section is kept at a 5° pitch relative to the horizontal plane X. The advantage of having this pitched gangway 100 is that is can be subjected to a high capacity load. The gangway 100 using the hinge system 1,1*a* is capable of a high load capacity of at least 1600 kg/m$^2$ and upwards to about 2500 kg/m$^2$. The increased load capacity of the gangway 100 is, in part, due to the 5° pitch of the hinged section of the gangway when in use.

A typical gangway 100 is 6.2 meters long when in use, and 3 meters in length in storage on board a vessel. When the gangway 100 is in use the locking means 140 is accommodated within an aperture 142 located on the upper surface 104 of the proximal end 107 of the sections 102*a*,102*b*. The locking means 140, such as a safety bolt, passes through the aperture 142 on the adjoining sections 102*a*,102*b* to secure the sections 102*a*,102*b* in place when in use and prevent the gangway 100 from collapsing. Once secured, the user(s) will lift the gangway 100 onto the railing of the vessel with the wheels 109 first and lower the gangway 100 onto a pier and rest it on the vessels railing. At that point, locking pins will be put into place so as to keep the gangway 100 from lifting of the hand rail. The locking pins can be any locking pins known to the person skilled in the art. Further, the locking pins can also be used to keep the gangway in a folded/collapsed state when in storage.

Figure 6:
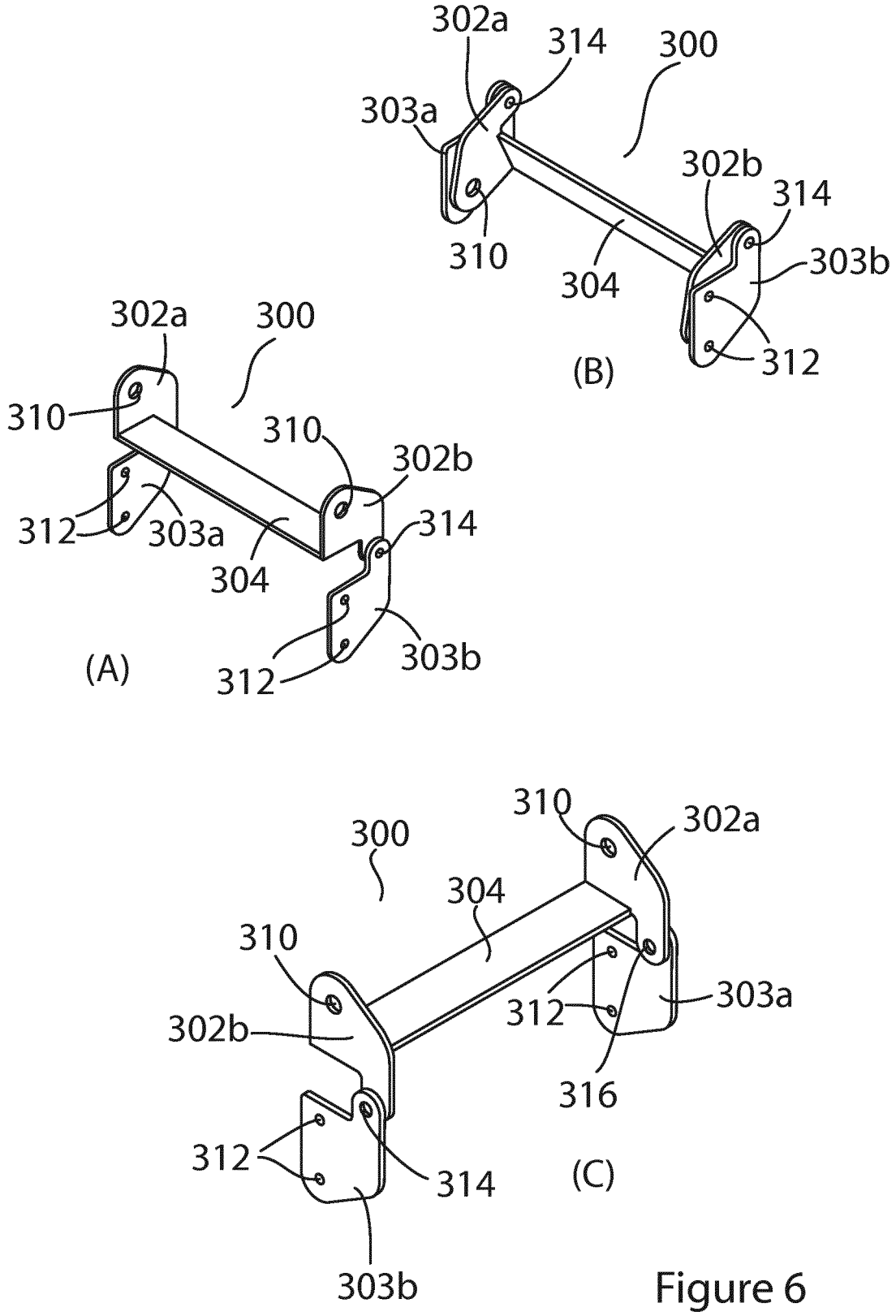
FIG. 6 illustrates (A) a perspective view in a working position, (B) a perspective view in a folded position and (C) a further perspective view in a working position of a rail bracket used to attach the gangway to a rail of a vessel or a structure such as a pier.
Figure 7:
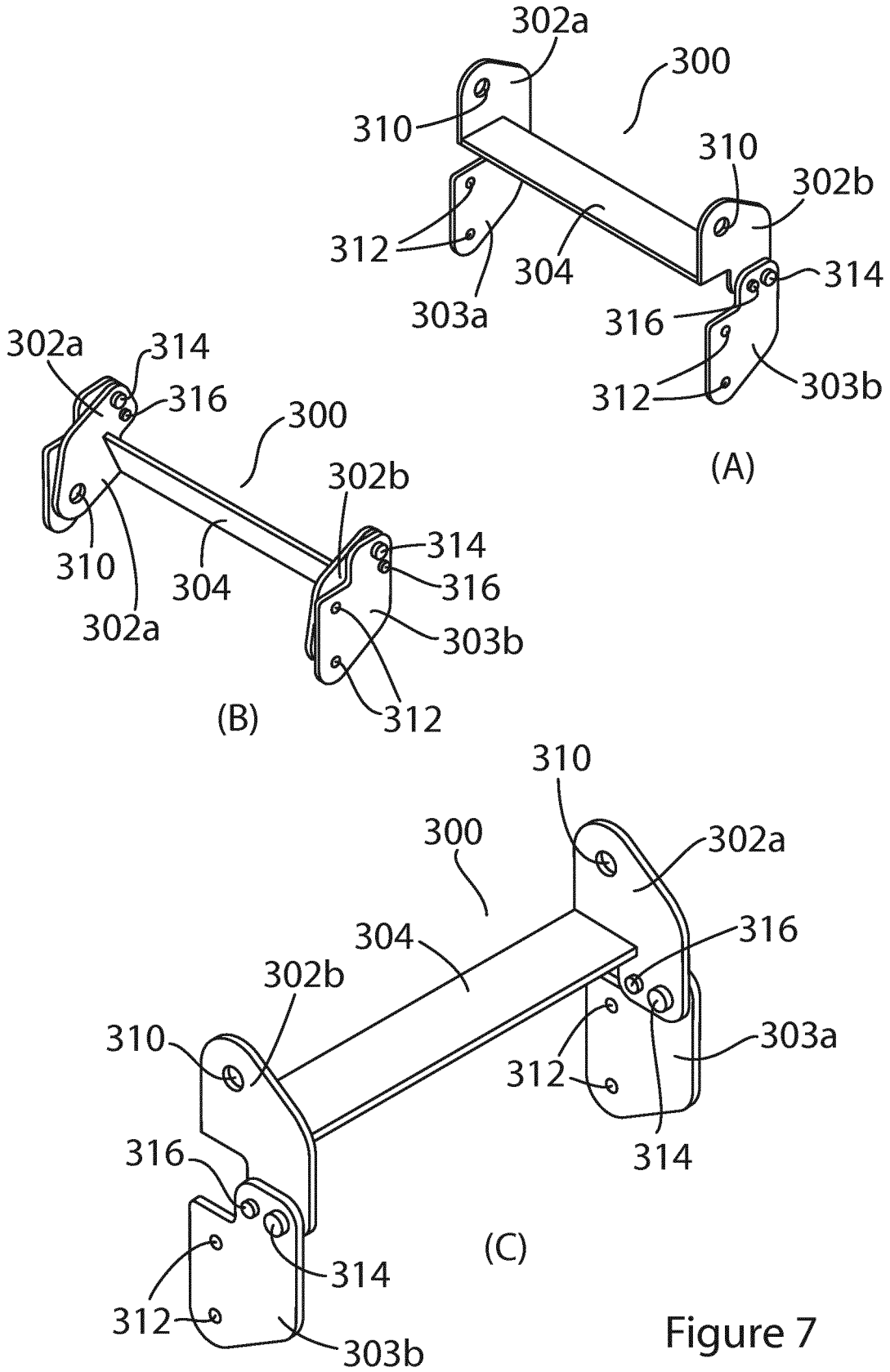
FIG. 7 illustrates (A) a perspective view in a working position, (B) a perspective view in a folded position and (C) a further perspective view in a working position of a rail bracket used to attach the gangway to a rail of a vessel or a structure such as a pier.

Turning now to FIG. 6 and FIG. 7, there is illustrated a rail bracket 300 suitable for attaching to the gangway 100 and which will be secured to a vertical frame under a horizontal rail on a vessel to accommodate attachment of the gangway 100 to the vessel. The rail bracket 300 comprises a first pair of plates 302*a*,302*b* positioned apart and connected to a base 304, and a second pair of plates 303*a*,303*b*. The base 304 being perpendicular to the first pair of plates 302*a*,302*b*. The plates 302*a*,302*b* and the base 304 each comprise at least one aperture 310 adapted for use in attaching the rail bracket 300 to the gangway 100.

The second pair of plates 303*a*,303*b* are pivotally connected to the first pair of plates 302*a*,302*b*, respectively, via a pivot pin 314 that securely engages with the plates through an aperture in each (not shown in the figures). The second pair of plates 303*a*,303*b* are typically bolted or secured to the vertical frame of the horizontal rail on the vessel or to a vertical frame on a pierhead or other structure to allow the gangway 100 to be secured thereto. The rail bracket 300 allows the gangway 100 to pivot about 360 degrees.

In one aspect, the plates 302*a*,303*a* and 302*b*,303*b* can be locked together in a working or folded position by engagement of a locking pin 316 (see FIG. 7). The locking pin 316 prevents to the rail bracket 300 from moving about its pivoting axis. When the locking pin 316 is engaged the rail bracket 300 is in position to connect the gangway 100. The purpose of the locking pin 316 is if there is a direct push on the bracket 300, the locking pin 316 keeps the gangway 100 from lifting off the rail or vertical frame it is secured to.

The plates 302*a*,302*b* are hingedly connected to the vertical frame and the base 304 will be hingedly connected to the vertical frame. This arrangement permits the rail bracket 300 to hinge or swivel 180 degrees. When not in use, the rail bracket 300 is adapted to be store under the horizontal rail of the vessel. When in use, the rail bracket 300 will swivel up onto the top of the horizontal rail, at which point the gangway 100 will be attached to the rail bracket 300 with a suitable pin or bolt (for example, a 30 mm stainless steel pin).

The advantages of the gangway 100 described herein can be stored in confined spaces on board a boat; it is lightweight for manoeuvrability and can be lifted by a two people; it is foldable/collapsible; the hinge system 1 also has advantages in that it can withstand heavy loads and the structure of the channel is also designed to withstand heavy loads; the components of the hinge system 1 and the locking pins are integrated within the body 103 of the sections 102*a*,102*b* of the gangway 100, so there are no loose components that can easily be lost; and the gangway 100 can be stored easily. The rail bracket can be removed from the gangway 100 without unbolting or disconnecting. It can be fitted to any rail around the vessel making the attachment of the gangway 100 to the vessel very versatile. The gangway 100 is also versatile in that it can be used from vessel to shore, vessel to vessel, and vessel to a structure such as a pier head, a transom swivel or gunwale steps. Other advantages include the manual folding mechanism for easy storage; collapsible handrails; adjusts accordingly with the tide; has a tread plate steps for maximum strength and safety; and drainage perforation incorporated into steps to prevent pooling of liquid on the gangway sections.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiments hereinbefore described but may be varied in both construction and detail.

What is claimed is:

1. A hinge system for use with a gangway, that is lightweight and portable, for a ship or a boat, the hinge system comprising:

at least three plates comprising a first plate, a second plate and a third plate, wherein each plate of said at least three plates having comprises a proximal end end, a distal end and an edged surface;

a bar and a washer, wherein a first pair of plates of the at least three plates comprising the first plate and the second plate are attached at either side of a lower surface of a first section of the gangway and the other third plate is' is attached at approximately a center of a second section of the gangway so that when the first section and the second section are brought towards each other, the proximal end of the first plate and the proximal end of the second plate are aligned with the proximal end of the third plate;

wherein the gangway comprises at least two gangway sections, wherein each gangway section of the at least two gangway sections comprise a body having an upper surface and a lower surface, a distal end and a proximal end, wherein the proximal end of said each gangway section is formed at an oblique angle of between 0.1° and 4.9° relative to a vertical axis which cooperates with the proximal end of another gangway section of the at least two gangway sections to form a hinged section.

2. The hinge system of claim 1, in which the first pair of the plates are welded on either side of the proximal end of either one of the sections first section and the second section and the other third plate is welded to approximately the center of the proximal end of either of the at least two gangway sections.

3. The hinge system according to claim 1, wherein the at least three plates comprise at least four plates that comprise the first pair of the plates, the third plate and a fourth plate such that the first pair of the plates are attached at said either side of a side of the lower surface of the first section of the gangway and a second pair of the plates comprising the third plate and the fourth plate are attached at either side of the second section of the gangway, so that when the first section and the second section are brought towards each other, the proximal end of the first plate and the proximal end of the second plate are juxtaposed to the proximal end of the third plate and the proximal end of the fourth plate, respectively.

4. The hinge system of claim 1, wherein the at least three plates comprise at least four plates that comprise the first pair of the plates, the third plate and a fourth plate, such that the first pair of the plates are attached at said either side of a side of the lower surface of the first section of the gangway and a second pair of the plates comprising the third plate and the fourth plate are attached at either side of the second section of the gangway, so that when the first section and the second section are brought towards each other, the proximal end of the first pair of the plate and the proximal end of the second plate are juxtaposed to the proximal end of the second pair of the plates third plate and the proximal end of the fourth plate, respectively, and in which the first pair of the plates and the second pair of the plates are welded on either side of the proximal end of the first section and the second section.

5. The hinge system according to claim 1, wherein the at least three plates comprise at least four plates that comprise the first pair of the plates, the third plate and a fourth plate, such that the first pair of the plates are attached at said either side of the lower surface of the first section of the gangway and a second pair of the plates comprising the third plate and the fourth plate are attached at either side of the second section of the gangway so that when the first section and the second section are brought towards each other, the proximal end of the first pair of plate and the proximal end of the second plate are juxtaposed to the proximal end of the third plate and the proximal end of the fourth plate, respectively, and in which when the at least four plates are juxtaposed each other, the first pair of the plates are external to the second pair of the plates.

6. The hinge system of claim 1, wherein said each plate of the at least three plates further comprises a notch, and wherein said each plate tapers from the proximal end to the distal end.

7. The hinge system according to claim 1, wherein said each plate of the at least three plates further comprises a notch, and wherein said each plate tapers from the proximal end to the distal end end, and in which the proximal end has a surface area greater than that of the distal end and further comprises an aperture.

8. The hinge system according to claim 1, wherein the at least three plates comprises at least four plates, such that each plate of said at least four plates further comprises a notch, and wherein said each plate of the at least four plates tapers from the proximal end to the distal end; in which the proximal end has a surface area greater than that of the distal end and further comprises an aperture; and in which when the bar is threaded through the aperture of the first pair of the plates and the third plate or through the first pair of the plates and a second pair of the plates comprising the third plate and a fourth plate, the washer is welded to the first pair of the plates and the bar, securing the bar in place.

9. The hinge system (1,1*a*) according to claim 1, wherein the at least three plates comprises at least four plates comprising the first pair of the plates, the third plate and a fourth plate, wherein each plate of the at least four plates tapers from the proximal end to the distal end; in which the proximal end has a surface area greater than that of the distal end and further comprises an aperture; in which when the bar is threaded through the aperture of the first pair of the plates and the other plate third plate or through the first pair of the plates and the and a second pair of the plates comprising the third plate and the fourth plate, the washer is welded to the first pair of the plates and the bar, securing the bar in place; and in which when the bar is threaded through the aperture of the at least four plates, the first pair of the plates and the second pair of the plates attached to the first section and the second section pivot around the bar.

10. The hinge system according to claim 1, wherein said each plate is constructed from a lightweight material selected from aluminum, carbon steel, graphene, titanium, nylon, fiberglass, aluminum steel, carbon fiber and plastic.

11. The hinge system according to claim 1, wherein said each plate is constructed from abrasion resistant steel or stainless steel.

12. The hinge system according to claim 1, wherein said each plate is between about 100 mm to about 400 mm in length and about 50 mm to about 150 mm in height at the proximal end.

13. The hinge system according to claim 1, wherein the each plate is between about 12 mm to 20 mm thick.

14. The hinge system according to claim 1, wherein the bar is constructed from stainless steel, abrasion resistant steel, carbon steel, nylon, graphene or titanium.

15. The hinge system according to claim 1, wherein said hinged section of the gangway is at a pitch of about 5° relative to a horizontal plane X.

16. The hinge system according to claim 1, wherein said upper surface further comprises a plurality of steps integrated into the body a body of the first section and the second section.

17. The hinge system according to claim 1, wherein the distal end further comprises a pair of wheels.

18. The hinge system according to claim 1, wherein the gangway can be folded compactly by pivoting the first section around the hinge system such that the first section rests on the second section.

19. The hinge system according to claim 1, wherein the proximal end further comprises an aperture suitable to accommodate a locking means to secure the first section and the second section together when the gangway is in use.

* * * * *